US006236002B1

(12) United States Patent
Chou

(10) Patent No.: US 6,236,002 B1
(45) Date of Patent: May 22, 2001

(54) MULTIPLE SWITCH ASSEMBLY INCLUDING CAM OPERATED ROTARY SWITCH CONTACTS AND AXIALLY LOCATED PUSHBUTTON SWITCH

(75) Inventor: Chin-Wen Chou, Taipei (TW)

(73) Assignee: Shin Jiuh Corp., Taipei Hsien (TW)

( * ) Notice: Subject to any disclaimer, the term of this patent is extended or adjusted under 35 U.S.C. 154(b) by 0 days.

(21) Appl. No.: 09/563,344

(22) Filed: May 3, 2000

(51) Int. Cl.[7] ..... H01H 9/00; H01H 13/72; H01H 19/02

(52) U.S. Cl. ..... 200/4; 200/1 R; 200/6 B; 200/11 R; 200/568

(58) Field of Search ..... 200/1 A, 4, 5 R, 200/5 A, 6 R, 6 B, 6 BA, 6 BB, 6 C, 11 R–11 TW, 14, 558, 559, 562–569, 573, 303, 1 R, 574, 292

(56) References Cited

U.S. PATENT DOCUMENTS 4,133,990 * 1/1979 Wanner et al. ..... 200/6 B
4,539,444 * 9/1985 Senoh ..... 200/5 R
4,758,693 * 7/1988 Hoffman ..... 200/11 R
5,008,498 * 4/1991 Yamazaki ..... 200/11 R
5,010,214 * 4/1991 Yamaxaki ..... 200/6 B
5,315,077 * 5/1994 Simon et al. ..... 200/11 R
5,436,413 * 7/1995 Katakami ..... 200/14
5,847,335 * 12/1998 Sugahara et al. ..... 200/4
5,952,628 * 9/1999 Sato et al. ..... 200/4

* cited by examiner

*Primary Examiner*—J. R. Scott
(74) *Attorney, Agent, or Firm*—Bacon & Thomas, PLLC

(57) ABSTRACT

A rotary switch has a rotary dial, an operation shaft, a housing, a rotary plate and a circuit board. A binding member extends from the rotary dial and inserts through a central through hole of the housing and connects to the contact plate to allow the rotary dial and the contact plate to rotate together. The housing and the circuit board attach and remain stationary, independent of any rotational movement of the rotary dial. The contact plate has a plurality of contact protrusions that extend in a predetermined pattern so that in accordance with rotation of the rotary dial, at least one contact protrusion is brought into electrical contact with at least one linear contact member belonging to a contact member array positioned on the circuit board. The rotary switch operates when a shaft contact portion mounted on the circuit board is pressed by a lower end of the operation shaft in accordance with axial movement of the operation shaft.

10 Claims, 11 Drawing Sheets

| Decimal Number | Binary Equivalent | Gray Code Equivalent |
|---|---|---|
| 0 | 0000 | 0000 |
| 1 | 0001 | 0001 |
| 2 | 0010 | 0011 |
| 3 | 0011 | 0010 |
| 4 | 0100 | 0110 |
| 5 | 0101 | 0111 |
| 6 | 0110 | 0101 |
| 7 | 0111 | 0100 |
| 8 | 1000 | 1100 |
| 9 | 1001 | 1101 |
| 10 | 1010 | 1111 |
| 11 | 1011 | 1110 |
| 12 | 1100 | 1010 |
| 13 | 1101 | 1011 |
| 14 | 1110 | 1001 |
| 15 | 1111 | 1000 |

MULTIPLE SWITCH ASSEMBLY INCLUDING CAM OPERATED ROTARY SWITCH CONTACTS AND AXIALLY LOCATED PUSHBUTTON SWITCH

BACKGROUND OF THE INVENTION

This invention relates to a rotary switch and, more particularly, to a rotary switch that can create multiple sets of circuit signals by using a rotary dial that has a plurality of multiple sets of contacts that engage with other associated contacts on a circuit board.

A mouse and a plurality of function keys are provided on a computer keyboard to improve user operativity. Typically, twenty-four function keys are provided on a conventional keyboard. By providing a plurality of function keys, a user can enter a variety of software commands by pressing a single function key. However, a plurality of function keys occupy a considerable amount of space on a computer keyboard. Thus, a problem arises concerning how to provide more function keys without expanding the size of the keyboard.

A conventional function key is designed for a single group mode, that is, a user has to further select a specified program in a sub-routine after entering a window by pressing a function key. Such a process insufficiently enhances the keyboard operativity.

In order to avoid an increase in production cost and prevent expansion of keyboard size, efforts have been made to group function keys in a rotary switch, as shown in FIG. 1. In the rotary switch of FIG. 1, however, a signal is transmitted by a single step rotation that potentially may cause a repetitive or erroneous instruction that will lead to undesirable results.

SUMMARY OF THE INVENTION

The primary object of this invention is to group a plurality of function keys in a two-stage controllable rotary switch, wherein multiple sets of contact protrusions extend radially in a predetermined pattern on a contact plate to communicate with a contact member array on a circuit board so as to produce multiple sets of circuit signals. The circuit signals are only transmitted to a host computer by depressing an operation shaft so as to avoid repetitive or erroneous instruction. As the function keys are integrated in a rotary switch on a group basis, the operativity is enhanced without expanding the keyboard volume.

Another object of this invention is to provide a contact member array on a planar circuit board that comprises a plurality of resilient, linear members. The resilient, linear members have a portion projecting transversely of the plane of the circuit board. The portion projecting from the circuit board is arranged so as to form at least one contact point that communicates with one of the contact protrusions. Additional features of this invention will become apparent from the ensuing descriptions of this invention.

DETAILED DESCRIPTION OF THE PREFERRED EMBODIMENT

Figure 1:
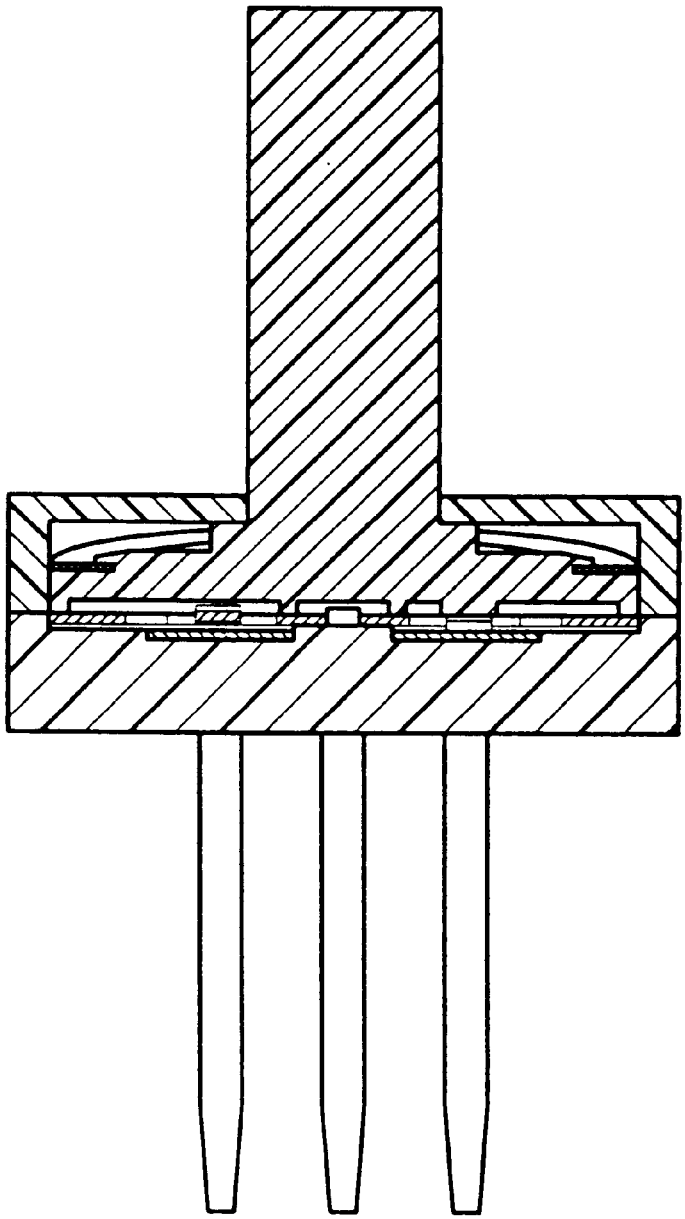
Fig. 1 PRIOR ART
FIG. 1 is a sectional view of a conventional rotary switch.
Figure 2:
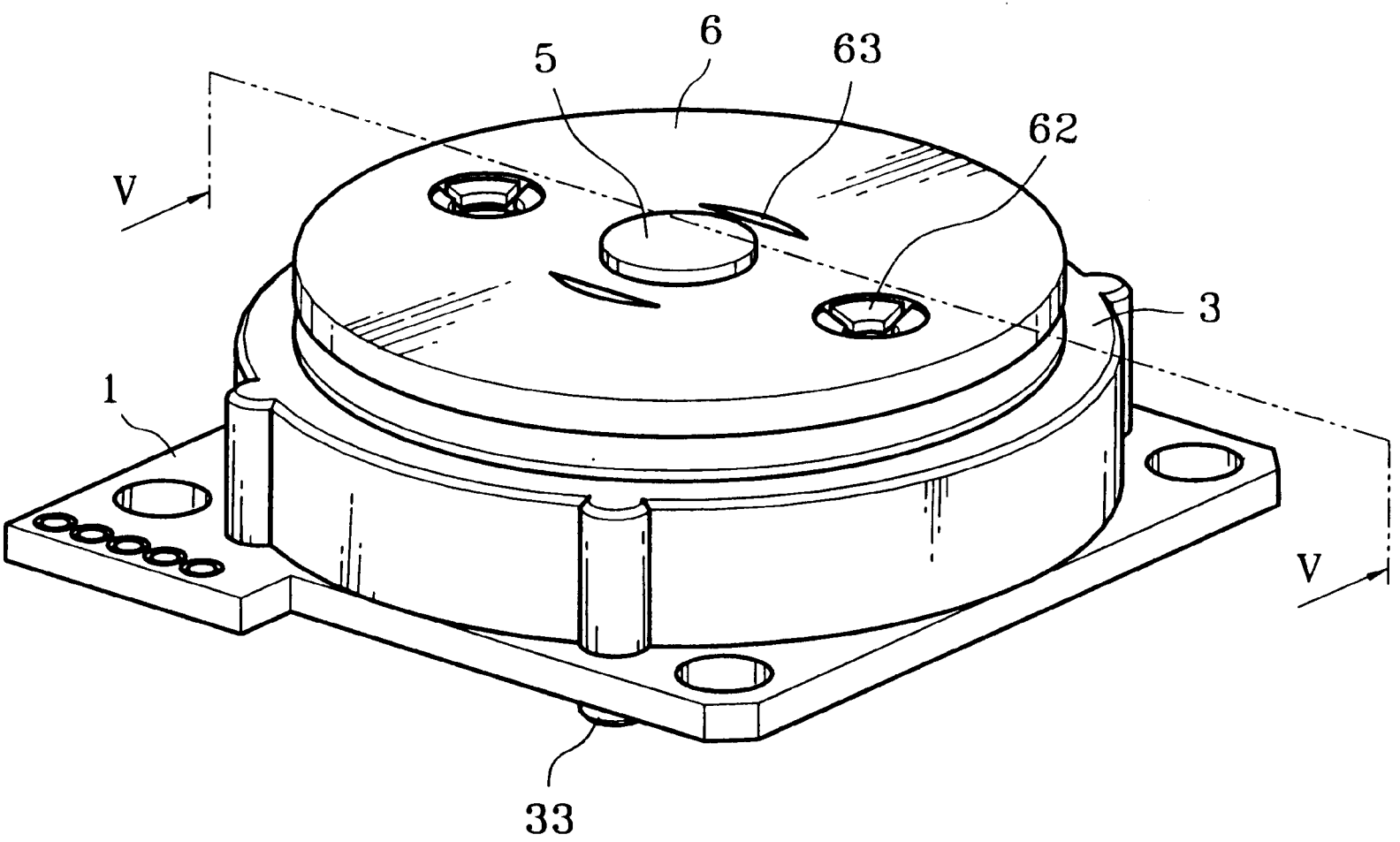
FIG. 2 is a perspective view of a rotary switch with a rotatable dial and an operation shaft.
Figure 3:
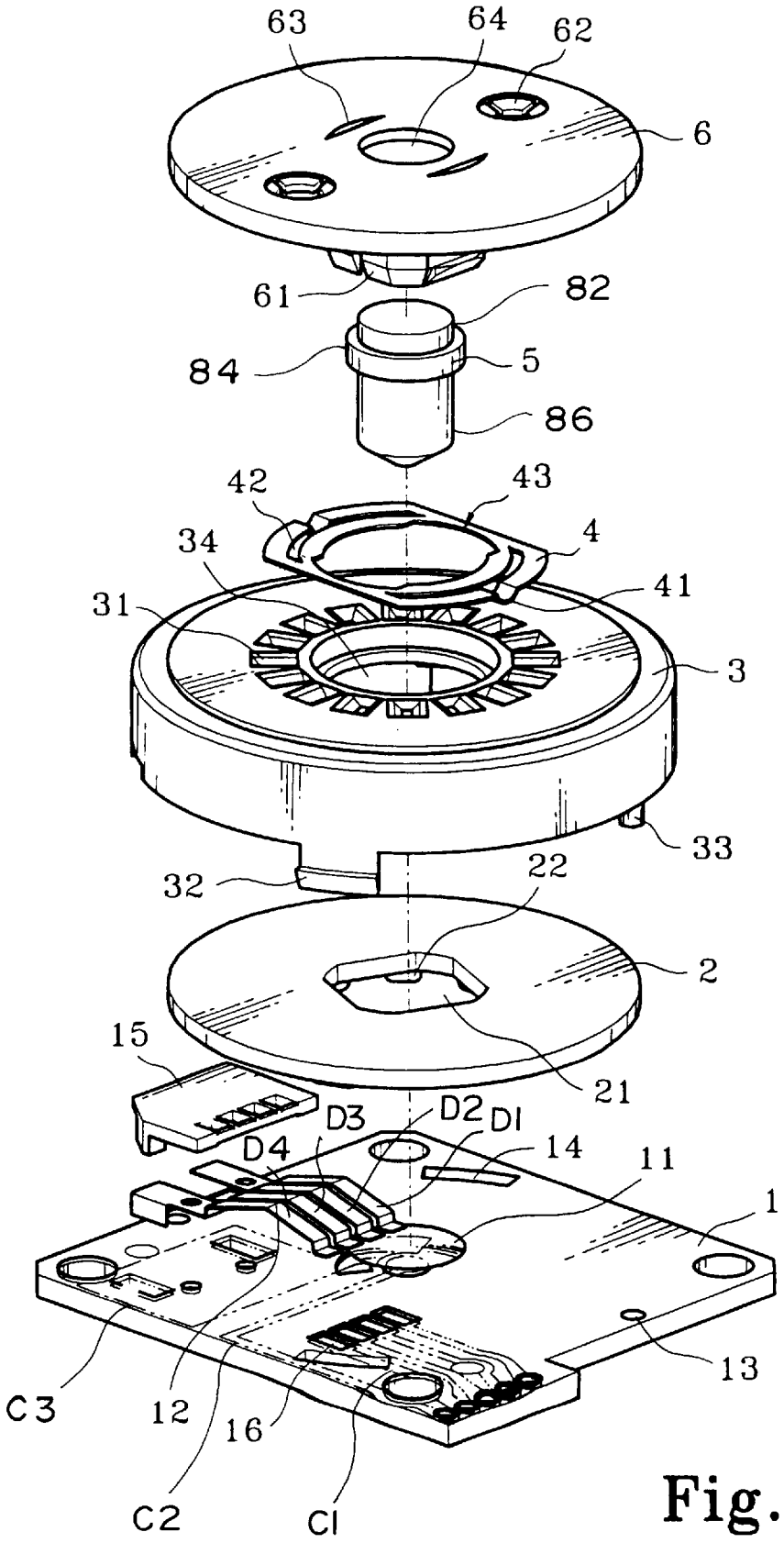
FIG. 3 is an exploded elevation perspective view of a rotary switch.
Figure 4:
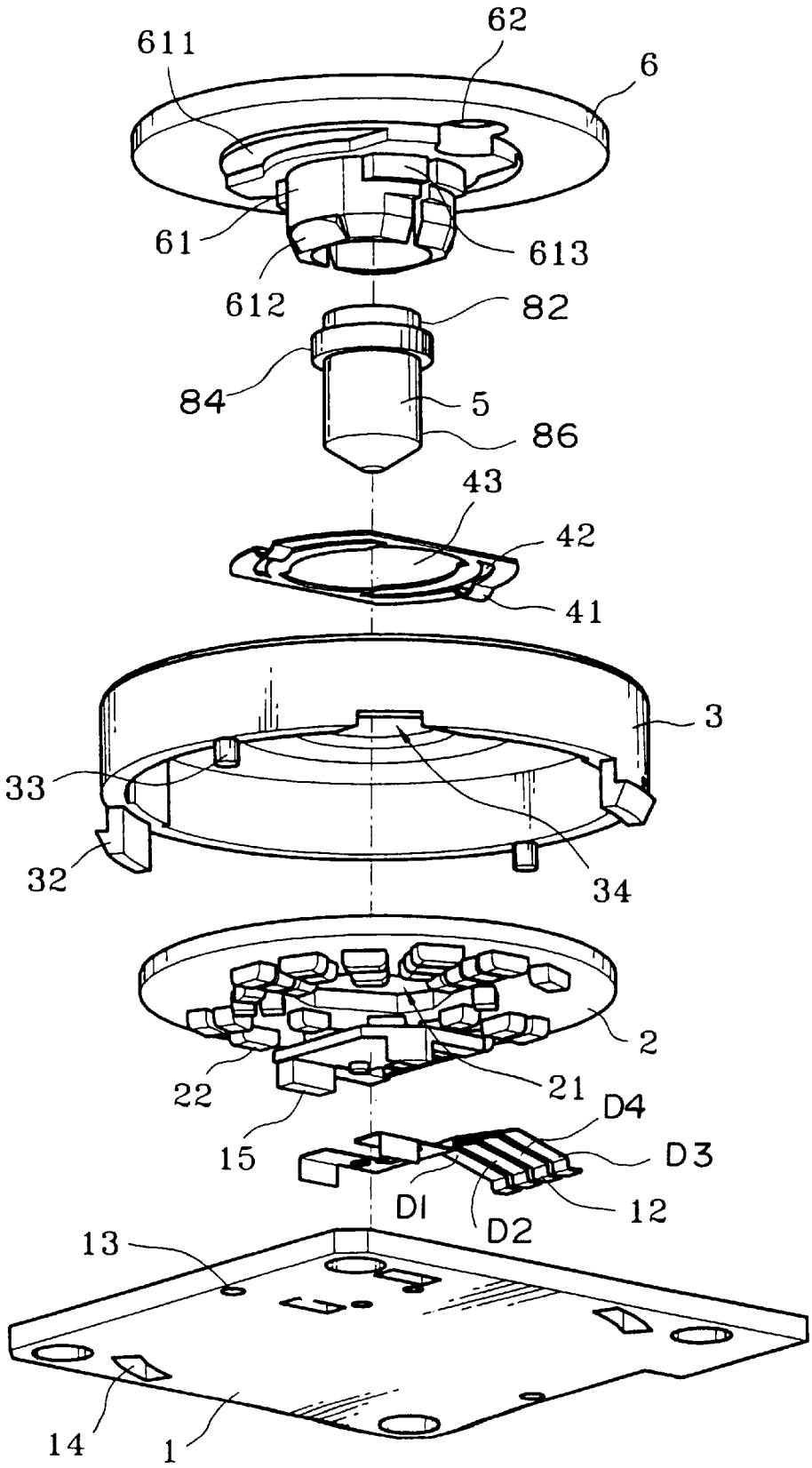
FIG. 4 is an exploded elevation perspective view a rotary switch.
Figure 5A:
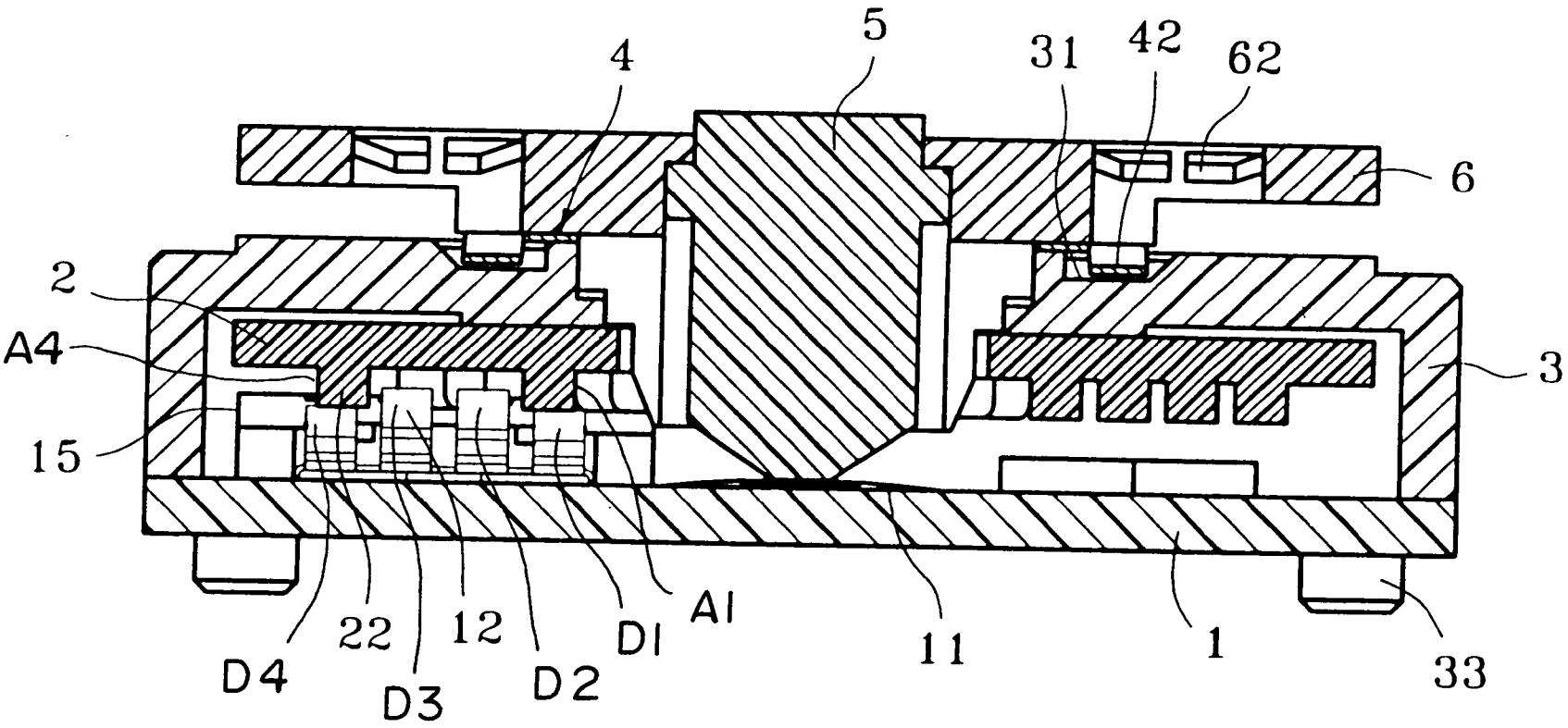
FIG. 5A is a sectional view taken along line V—V of FIG. 2.
Figure 5B:
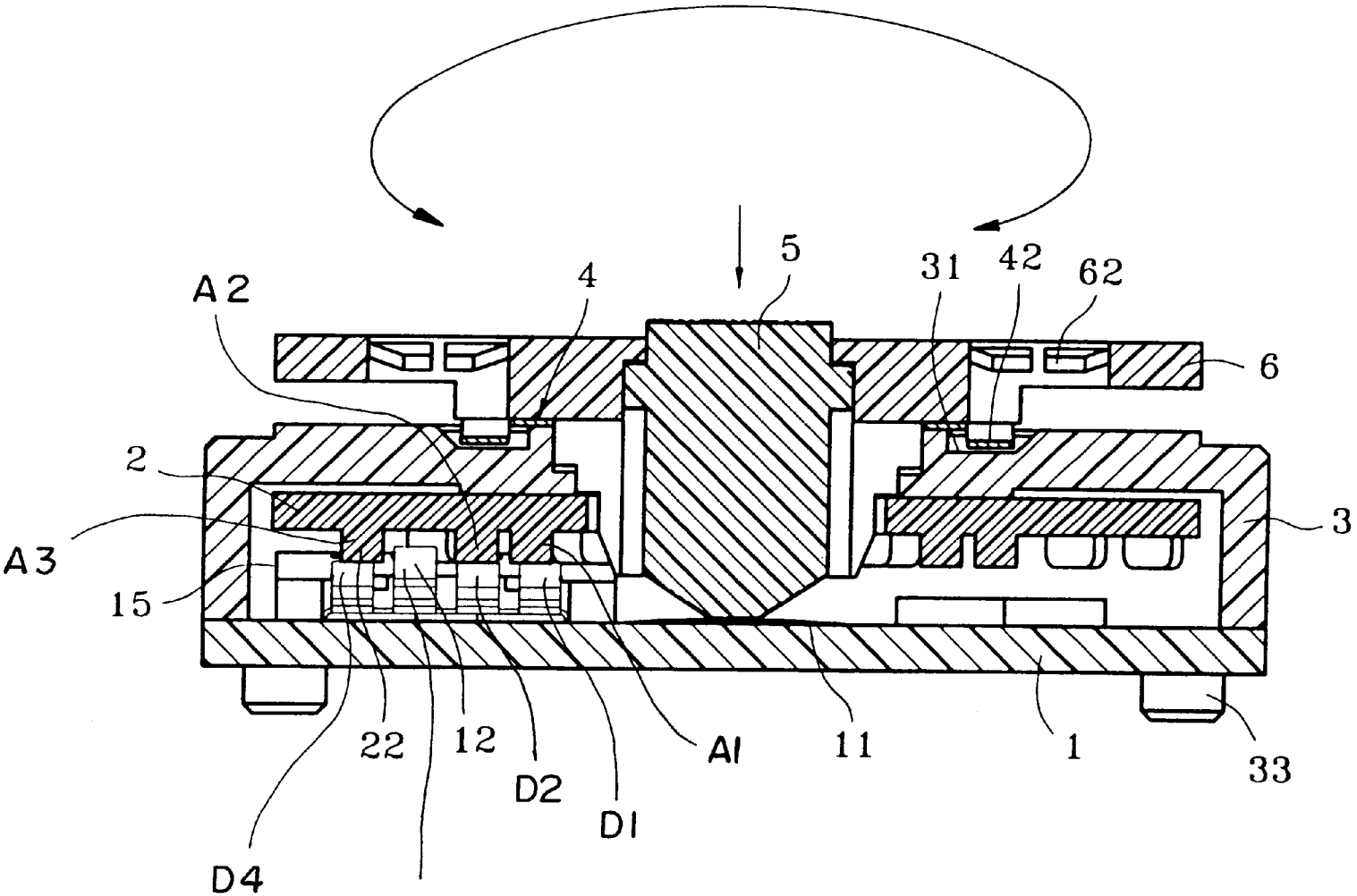
FIG. 5B is a sectional view taken along line V—V of FIG. 2 showing a direction of rotation of a rotary dial and operation direction of a operation shaft.

As shown in FIGS. 2, 3, 4, 5A, a rotary switch of this invention serving for a plurality of function keys comprises a rotary dial 6, a housing 3 as a platform supporting the rotary dial 6, a resilient indexing ring 4 disposed between the rotary dial 6 and the housing 3, a contact plate 2 which is positioned on the housing 3 and rigidly attached to the rotary dial 6, and a planar, plate-shaped circuit board 1 connected to the housing 3.

The rotary dial 6 comprises a first, central through hole 64 and a cylindrical, binding member 61 that extends from the peripheral edge of the first through hole 64 and is also coaxial to the first through hole 64. An operating shaft 5 includes an upper portion 82 that has a first diameter smaller than the diameter of a first through hole 64, a mid-upper portion 84 having a second diameter greater than the diameter of the first through hole 64, and a lower portion 86 having a third diameter of the same size as the first diameter. The upper portion 82 extends upward through the binding member and the first, through hole 64. The lower portion 86 extends through the resilient, indexing ring 4, a second, central through hole 34 belonging to the housing 3, and a third, central through hole 21 belonging to the contact plate 2 so as to be operatively engageable with a shaft contact portion 11 belonging to the circuit board 1.

The resilient, indexing ring 4 is disposed between the housing 3 and the rotary dial 6. The indexing ring 4 has a pair of diametrically opposed ridges 41 that engage with radially extending grooves 31 spaced along a circumferential direction at regular intervals on one surface of the housing 3.

The binding member 61 has a stepped profile comprising a first jointing zone 611 for snap jointing with a snap hole 42 belonging to the indexing ring 4, a socket zone 613 for coupling with the housing 3, and a second jointing zone 612 for coupling with the third, through hole 21. The above-mentioned arrangement results in the rotary dial 6, the indexing ring 4, the operation shaft 5, and the contact plate 2 being assembled so as to be rotatable together. A projecting member 32 and a projecting pin 33 of the housing 3 with an associated joining slot 14 and a joining hole 13 of the circuit board 1 respectively join the housing 3 to the circuit board 1.

Referring to FIGS, 5B, 6A and B, a shaft contact portion 11 and a contact member array 12 are connected to each other by printed circuits 16 and are arranged on the circuit board 1 at proper positions, wherein the shaft contact portion 11 is connected with a second and a third circuit C2, C3 while the contact member array 12 is connected with a first and the second circuit C1, C2. The shaft contact portion 11 is a conductive resilient piece with a central protruding portion attached on the circuit board and is arranged so as to engage with a lower end of the operating shaft 5 in accordance with axial movement of the operating shaft 5. The contact member array 12 further comprises a plurality of resilient, linear members D1, D2, D3, D4 arranged so as to permit individual movement from each other and to project transversely of the plane of the circuit board 1 so as to form at least one contact point B1, B3, B4 with at least one contact protrusion 22 belonging to the contact plate 2. The contact member array 12 also has at least one segregation projection 15 that is disposed between the circuit board 11 and the contact member array 12 so as to form a gap between the circuit board 11 and the contact member array 12. On the surface of the contact plate 2 facing the circuit board 1, the plurality of contact protrusions 22 are arranged in a predetermined pattern and extend radially from the third, through hole 21.

Figure 9:
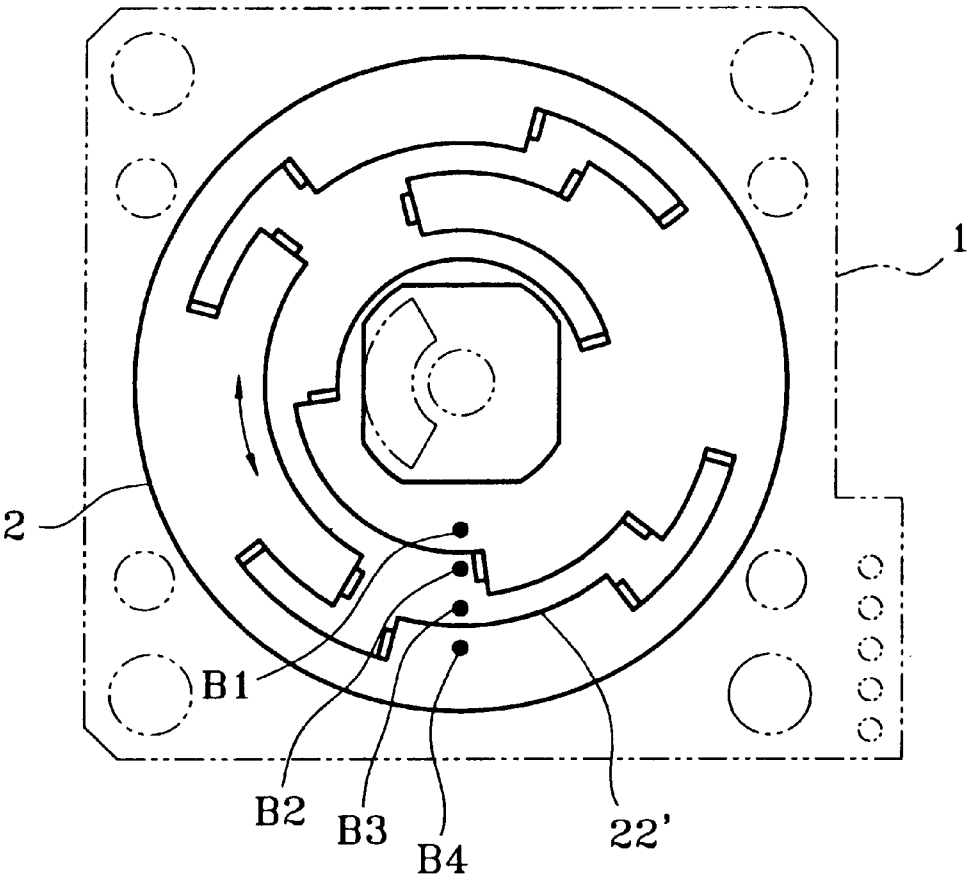
FIG. 9 is a plan view of another embodiment showing a pattern of the contact protrusions.

Another embodiment of the contact protrusions 22 is shown in FIG. 9. The operation and encoding are substantially the same, though there is a different contact protrusion pattern 22'.

When operating the rotary switch, a user applies force to a control area 62 on the rotary dial 6, and turn the rotates the rotary dial 6 until it reaches a desired finction key instruction shown in an orientation window 63. At this point, as the indexing ring 4 is disposed between the housing 3 and the rotary dial 6, and when the rotary dial is rotated, the ridges 41 of the indexing ring engage with the grooves 31 of the housing 3. The engagement of the ridges 41 with the grooves 31 provides the user an indication that the rotary switch is at a new position, and thus positions the contact plate 2.

Figure 6A:
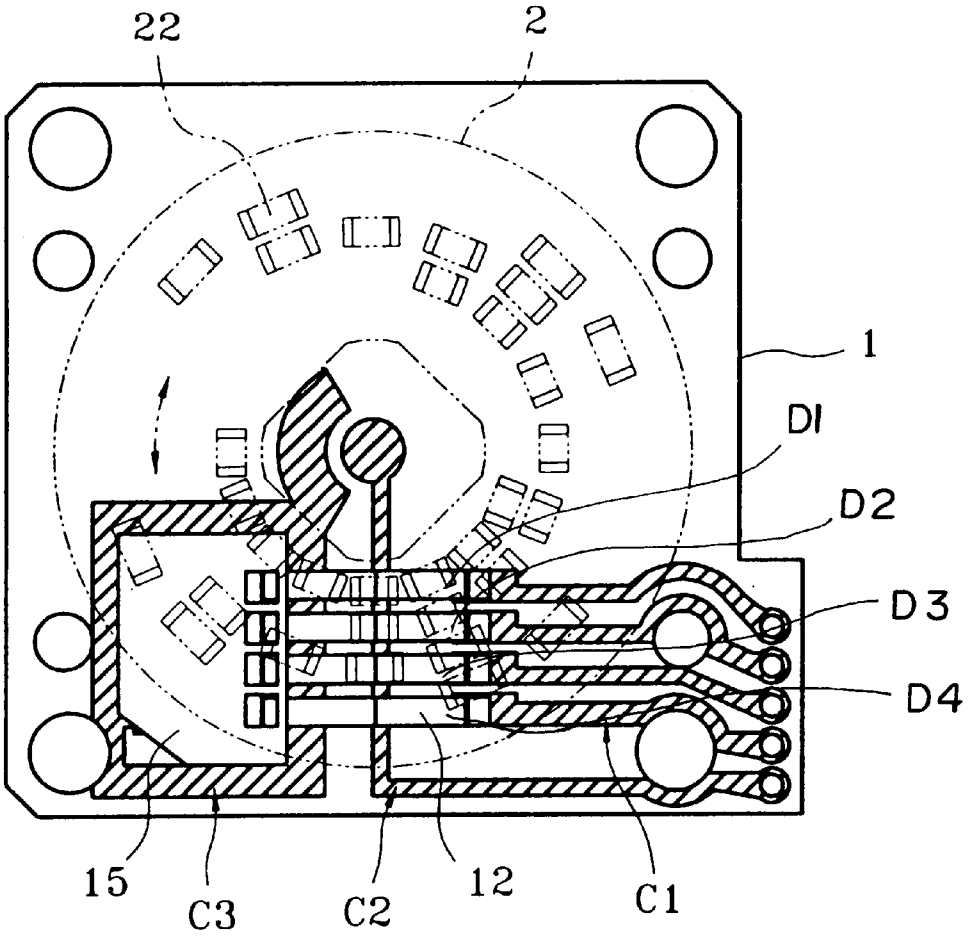
FIG. 6A is a sectional view showing a contact member array and a predetermined pattern of contact protrusions.
Figure 6B:
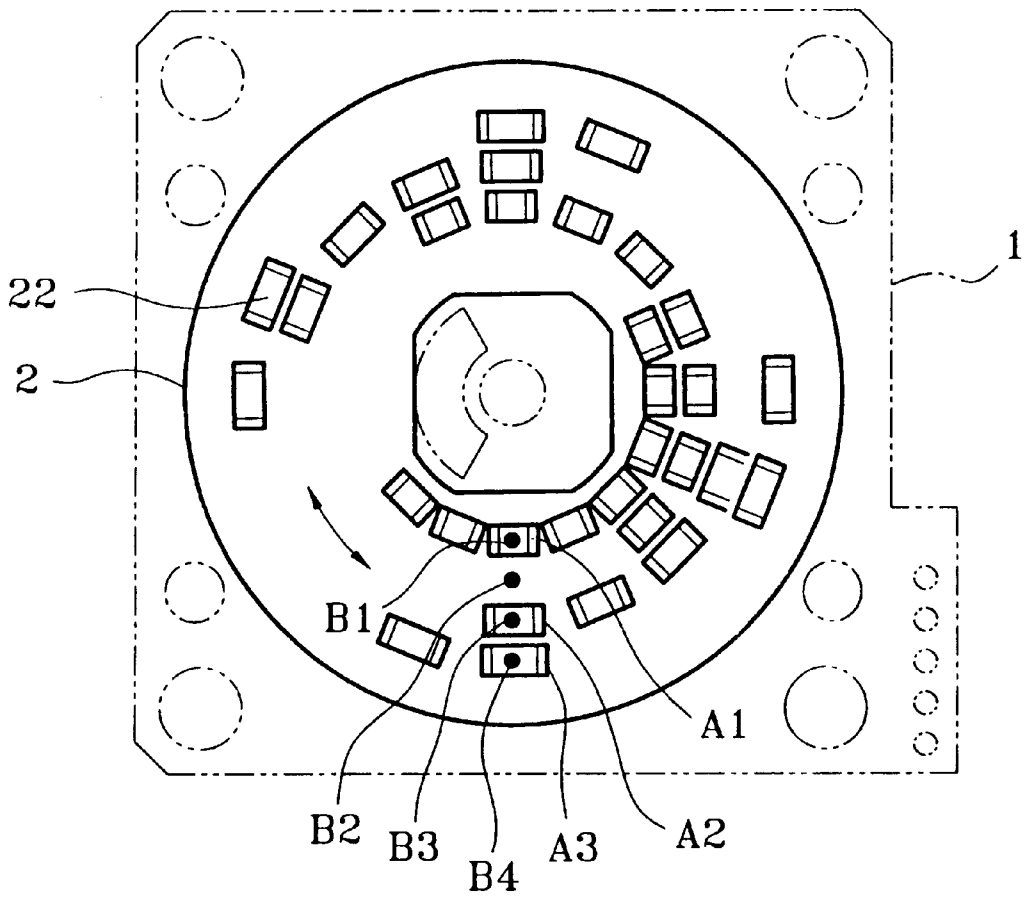
FIG. 6B is a sectional view showing contact points where contact members and contact protrusions connect.

When the rotary dial 6 and contact plate 2 are rotated, at least one contact protrusion 12 is brought into contact with at least one respective contact member of the contact member array 22. In FIG. 6B, contact protrusions A1, A2, and A3 contact members D1, D3, D4 at points B1, B3 and B4 respectively. The contact member D2 is in contact with the second circuit C2 located thereunder. The predetermined pattern of the contact protrusions 22 lacks a protrusion at point B2.

A user presses the operating shaft 5 to connect the second circuit C2 connected with the third circuit C3 so as to couple the circuit C1, C2, and C3 with each other and effect an instruction to the host computer machine for achieving the desired command.

Figures 7A, 7B:
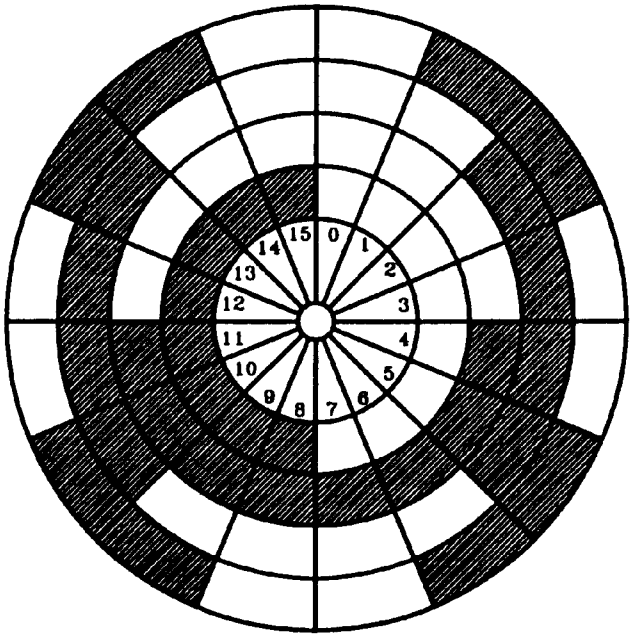
FIGS. 7A, 7B show binary encoding of this invention.

Regarding the encoding mode of this invention, the BCD (Binary Coded Decimal) and the Gray Coded Decimal system are adopted as shown in FIGS. 7A and 7B. Number 1~15 (0 for reset) represent specified file positions, web site assortments, multimedia play, and with a setup of associated software so as to simplify the computer application.

With the exception of 0, the cooperation of the contact protrusions 22 and the contact member array 12 can create 15 combination sets of circuit signals, namely, 15 function keys with different instructions. Further, the alignment and combination sets of the contact protrusions 22 may be diversified for minimizing occupied space and reducing production cost.

Figure 8:
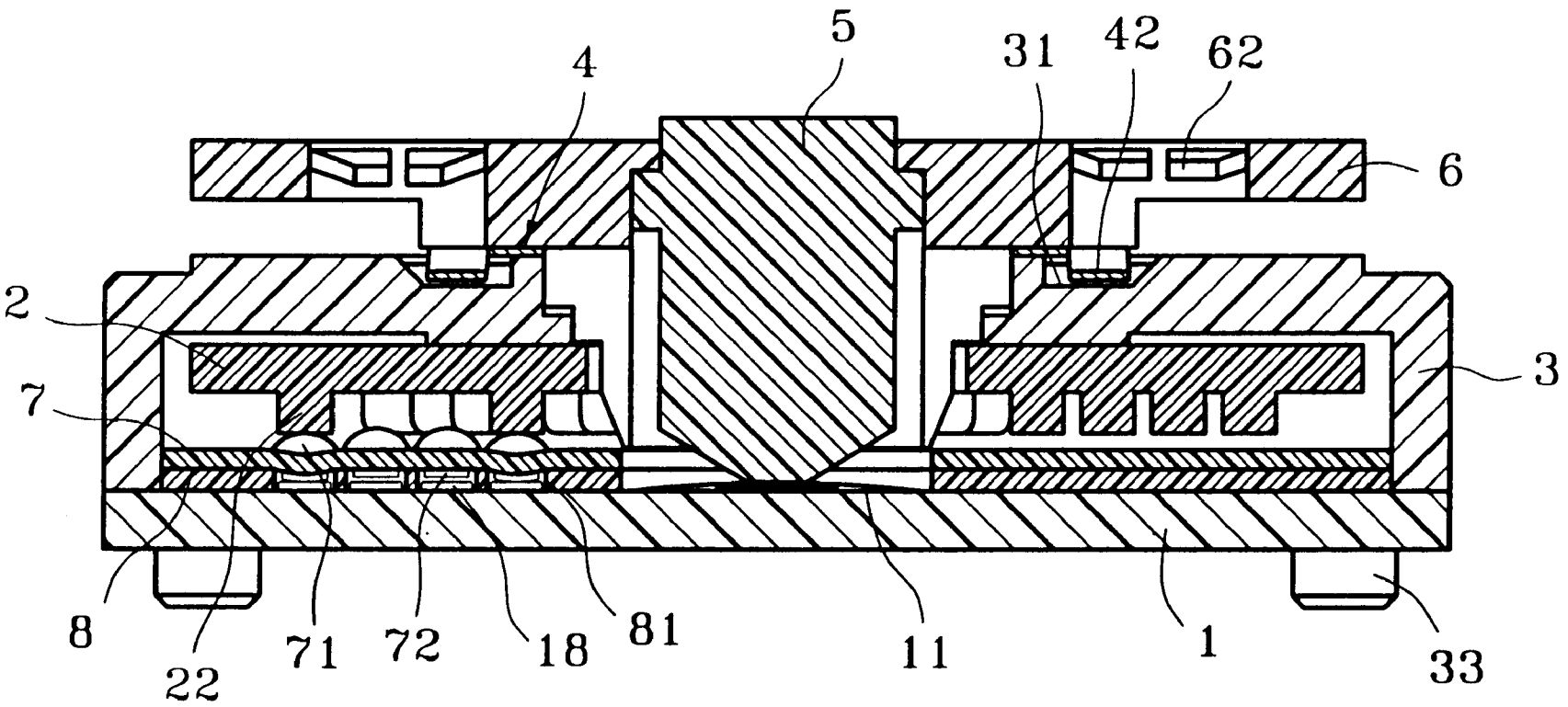
FIG. 8 is a sectional view of another embodiment of a rotary switch.

Referring to FIG. 8, the contact member array 12 comprises: a resilient piece 7 laid on the circuit board 1 with a plurality of contact points 71 at positions opposite to the contact protrusions 22, a segregation projection 8 disposed between the resilient piece 7 and the circuit board 1 being provided with a plurality of through holes 81 corresponding to the plurality of contact points 71, and a plurality of conductive points 18 formed on the circuit board 1 at positions opposite to the corresponding plurality of contact points 71. When an arbitrary set of contact projections 22 rotates to reach the contact member array 12, the contact projections 22 press down the contact points 71, and thereby the resilient piece 7 is driven to press down through one of the plurality of through holes 81 of the segregation projection 8 to enable another contact point 72 on the other face of the resilient piece 7 to contact with the conductive point 18 on the circuit board 1 to effect predetermined signals. The user then presses the operating shaft 5 for the shaft contact portion 11 to form the circuit so that the signals can be transmitted to the host computer.

Although, this invention has been described in terms of preferred embodiments, it is apparent that numerous variations and modifications may be made without departing from the true spirit and scope thereof, as set forth in the following claims.

What is claimed is:

1. A rotary switch comprising:

a rotary dial forming a first, central through hole and a cylindrical, binding member extending from a peripheral edge of said first through hole on one side of said rotary dial;

an operation shaft including an upper portion having a first diameter smaller than the diameter of the first through hole, a mid-upper portion having a second diameter greater than the diameter of the first through hole, and a lower portion having a third diameter the same as the first diameter, wherein the upper portion extends upward through the binding member and the first through hole;

a housing defining a chamber and having a second central through hole which receives the lower portion of said operation shaft and said binding member;

a contact plate having a third central through hole and a plurality of contact protrusions extending in a predetermined pattern, wherein the lower portion of the operation shaft and said binding member slidably extend through the third through hole, said binding member attaching to said contact plate so that said rotary dial and said contact plate are rigidly joined, said housing being interposed between said rotary dial and said contact plate;

a planar plate-shaped circuit board having a contact member array that is operably engageable against said contact protrusions and a shaft contact portion arranged so as to engage with a lower end of the lower portion of said operation shaft, said shaft contact portion operating when pressed by the lower end of the operation shaft in accordance with axial movement of said operation shaft, wherein said housing connects to said circuit board so as to allow said rotary dial to rotate together with said contact plate, said housing and said circuit board being stationary independent of the rotation of the rotary dial and the contact plate;

wherein, as the rotary dial is rotated, the contact plate is rotated so that at least one contact protrusion is brought into electrical contact with a linear contact member of said contact member array, said operating shaft transmitting a signal when depressed.

2. The rotary switch according to claim 1, wherein said housing having at least one projecting member projecting from a peripheral edge of said housing that engages with at least one joining slot formed by said circuit board.

3. The rotary switch according to claim 1, wherein said housing having at least one projecting pin projecting from a peripheral edge of said housing that engages with at least one joining hole formed by said circuit board.

4. The rotary switch according to claim 1, wherein said rotary dial includes an orientation window for displaying indicia indicating the relative position of the rotary dial and arranged so as to be manipulable by a user's hand.

5. The rotary switch according to claim 1, wherein said contact protrusions extend radially from said third central through hole.

6. The rotary switch according to claim 1, wherein said shaft contact portion comprises a central, resilient protruding portion that engages with said lower end of said operating shaft.

7. The rotary switch according to claim 1, wherein said contact member array comprises a plurality of resilient, linear contact members being fixedly attached to said circuit board.

8. The rotary switch according to claim 1, wherein said contact member array comprises a plurality of resilient, linear members and at least one segregation projection, said resilient, linear members having a portion projecting transversely of the plane of the circuit board so as form at least one contact point that communicates with at least one of said contact protrusions, said at least one segregation projection being interposed between said circuit board and said contact member array so as to form a gap between said circuit board and said contact member.

9. The rotary switch according to claim 1, wherein a resilient, indexing ring is interposed between said housing and said rotary dial, said indexing ring having a pair of diametrically opposed ridges that engage with radially extending grooves, spaced along a circumferential direction at equal angular intervals on one surface of said housing, said indexing ring being received by said binding member so as to be rotatable with said rotary dial.

10. The rotary switch according to claim 1, wherein said binding member having a stepped profile such that said binding member rigidly attaches to a resilient, indexing ring disposed between said rotary dial and said housing, said binding member also being slidably arranged through said second through hole so as to engage with said third through hole of said contact plate.

* * * * *